US006354001B1

(12) United States Patent
Asanuma

(10) Patent No.: US 6,354,001 B1
(45) Date of Patent: Mar. 12, 2002

(54) METHOD OF MANUFACTURING A TI ALLOY POPPET VALUE

(75) Inventor: Hiroaki Asanuma, Fujisawa (JP)

(73) Assignee: Fuji Oozx Inc., Kanagawa-Ken (JP)

( * ) Notice: Subject to any disclaimer, the term of this patent is extended or adjusted under 35 U.S.C. 154(b) by 0 days.

(21) Appl. No.: 09/573,426

(22) Filed: May 16, 2000

(30) Foreign Application Priority Data

Feb. 23, 2000 (JP) ..... 2000-045791

(51) Int. Cl.[7] ..... B23P 15/00

(52) U.S. Cl. ..... 29/888.451; 29/888.4; 29/888.44

(58) Field of Search ..... 29/888.451, 888.4, 29/888.43, 888.44; 123/188.3, 188.2; 148/566, 567, 669

(56) References Cited

U.S. PATENT DOCUMENTS 5,662,745 A * 9/1997 Takayama et al.
6,073,912 A * 6/2000 Mori et al. ..... 123/188.3
6,131,603 A * 10/2000 Takano et al. ..... 123/188.3
6,186,478 B1 * 2/2001 Hamada et al. ..... 123/188.3
6,200,688 B1 * 3/2001 Liang et al. ..... 123/188.3
6,209,197 B1 * 4/2001 Mori et al. ..... 29/888.43

FOREIGN PATENT DOCUMENTS

JP 62-197610 1/1987
JP 63-171604 8/1998

* cited by examiner

*Primary Examiner*—I Cuda-Rosenbaum
(74) *Attorney, Agent, or Firm*—Sheldon & Mak; Denton L. Anderson

(57) ABSTRACT

A bar material is made of an (α+β) or a near α Ti alloy which comprises a regular α structure, and the end thereof is heated at a temperature above its β transformation point by an electric forging device to form an enlarged portion. The enlarged portion is immediately formed by hot forging to make a valve head of a poppet valve which is employed in an internal combustion engine. The valve head comprises an acicular α structure which provides higher fatigue and tensile strengths.

8 Claims, 4 Drawing Sheets

METHOD OF MANUFACTURING A TI ALLOY POPPET VALUE

PRIORITY APPLICATION CLAIM

This application claims priority from Japanese Patent Application No. 200-45791 which is incorporated herein by reference.

BACKGROUND OF THE INVENTION

The present invention relates to a method of manufacturing a Ti alloy poppet valve having a valve head with improved high-temperature strength.

Instead of an ordinary heat-resistant steel, a poppet valve is formed out of a Ti alloy which has a low specific gravity and a high specific strength to decrease the inertia mass of a valve operating mechanism and to increase the performance in an internal combustion engine.

The heat resistance temperature of an ordinary ($\alpha+\beta$) alloy has an upper limit of about 500° C., which is lower than that of heat resistant austenite steel. Accordingly, it would be difficult to apply an ordinary Ti alloy to an exhaust valve in which a working temperature is higher than that of the inlet valve.

To overcome this problem Japanese Patent Pub. No. 62-197610 discloses the molding of a valve head having heat resistance and a valve stem which has a lower thermal load from a high heat-resistant Ti alloy such as Ti-6Al-2Sn-4Zr-2Mo and an ordinary Ti alloy such as Ti-6Al-4, respectively. Japanese Utility Model Pub. No. 63-171604 discloses a valve stem made of heat-resistant steel combined with a valve head made of a high heat-resistant Ti alloy and a valve stem made of Ti alloy combined with a valve head made of heat-resistant steel.

However, when a high heat-resistant alloy is used in the valve head as above, the heat-resistance temperature of the valve head is forged and manufactured below its $\beta$ transformation point to obtain ordinary hot forging or its regular $\alpha$ structure is limited to 600° C. Thus, there is a disadvantage in fatigue and tensile strengths to use such a valve as an exhaust valve for a high-load engine in which the temperature of the valve head becomes about 800° C.

In the conventional valve described above, the valve head and stem are made of different materials respectively, and the valve in which they are combined provides low tensile strength and reliability and increases the number of manufacturing steps, thereby increasing cost. Furthermore, a valve in which Ti alloy is connected to a heat-resistant steel could not lighten the valve.

SUMMARY OF THE INVENTION

In view of the disadvantages in the prior art, it is an object of the present invention to provide a method of manufacturing a Ti alloy poppet valve which is light and inexpensive so as to greatly improve the fatigue and tensile strengths which are required for a valve head under high temperature. The valve of the invention is made of a single alloy.

According to the present invention, there is provided a method of manufacturing a Ti alloy poppet valve, comprising the steps of: heating an end of a bar material made of an ($\alpha+\beta$) or near $\alpha$ alloy which comprises a regular $\alpha$ structure at a temperature above its $\beta$ transformation point to make an enlarged portion; and forming said enlarged portion by hot forging into a valve head having an acicular $\alpha$ structure.

The valve head is easily formed from the acicular $\alpha$ structure to increase fatigue and tensile strengths under high temperature. Compared with a conventional valve in which a valve stem is welded to a valve head, the valve of the invention is made of a single alloy. The valve of the present invention thereby provides higher strength, lighter weight and simplification of manufacturing steps.

BRIEF DESCRIPTION OF THE DRAWINGS

The features and advantages of the present invention will become more apparent from the following description with respect to embodiments based on the accompanying drawings wherein.

DETAILED DESCRIPTION OF PREFERRED EMBODIMENTS

Figure 1:
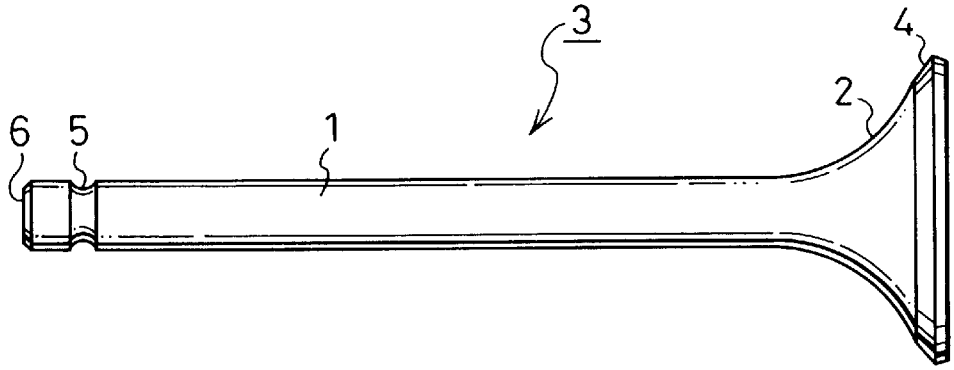
FIG. 1 is a front elevational view of a poppet valve manufactured by a method according to the present invention.

FIG. 1 illustrates a finished product of a Ti alloy poppet valve manufactured by a method of the present invention. A poppet valve 3 which comprises a valve stem 1 and a valve head 2 at the end thereof is made of an ($\alpha+\beta$) Ti alloy such as Ti-6Al-4V, Ti-6Al-6V-2Sn, Ti-6Al-2Sn-4Zr-6Mo, or a near $\alpha$ alloy which contains a little $\beta$ phase of less than 10%, such as Ti-6Al-2Sn-4Zr-2Mo and Ti-8Al-1Mo-1V.

Surface treatment such as nitriding, carburizing and ion plating is applied to a valve face 4, a portion of which contacts a valve guide, a cotter groove 5 and an axial end face 60 which require wear resistance, so that the surface layer which has a depth of 3 to 5 $\mu$m is hardened. The surface treatment may be applied to the whole surface of the valve 3. The whole valve head 2 comprises acicular a phase and is made dense.

A method of manufacturing the Ti alloy poppet valve is described below.

Figure 2:
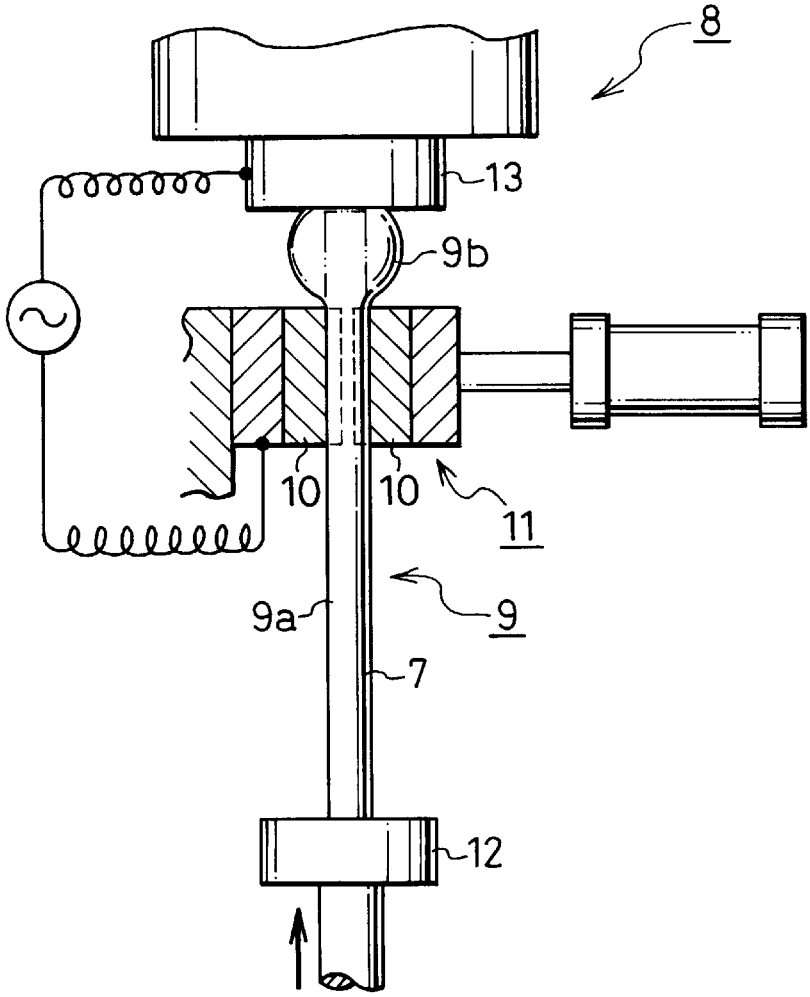
FIG. 2 is a partially cutaway front view which shows the step of forming an enlarged portion at one end of a valve stem.

As shown in FIG. 2, a bar material 7 made of an ($\alpha+\beta$) or a near a alloy which comprises a regular a structure is forged by an electric forging device or upsetter 8 to form a valve intermediate 9 which has an enlarged portion 9*b* at the upper end of a valve stem 9*a*.

The upper end of the bar material 7 is slidably supported by a lower electrode 11 which comprises a pair of electrode portions 10,10. By elevating an elevating table 12, the material 7 is pressed upwards and the upper end thereof is engaged with the lower surface of an upper electrode 13. At the same time, an electric current is applied to the upper and lower electrodes 11,13.

Thus, the upper end of the bar material 7 between the upper and lower electrodes 11,13 is locally heated by electric resistance, and softened. The elevating table 12 is further elevated, and the upper end of the material 7 is forged to form a high-temperature enlarged portion 9*b*.

By controlling the electric current which flows between the upper and lower electrodes 11, 13, the temperature of the enlarged portion 9*b* is increased above its β transformation point. The β transformation point is 995° C. for (α+β) alloy and 1015° C. for a near α alloy.

Figure 3:
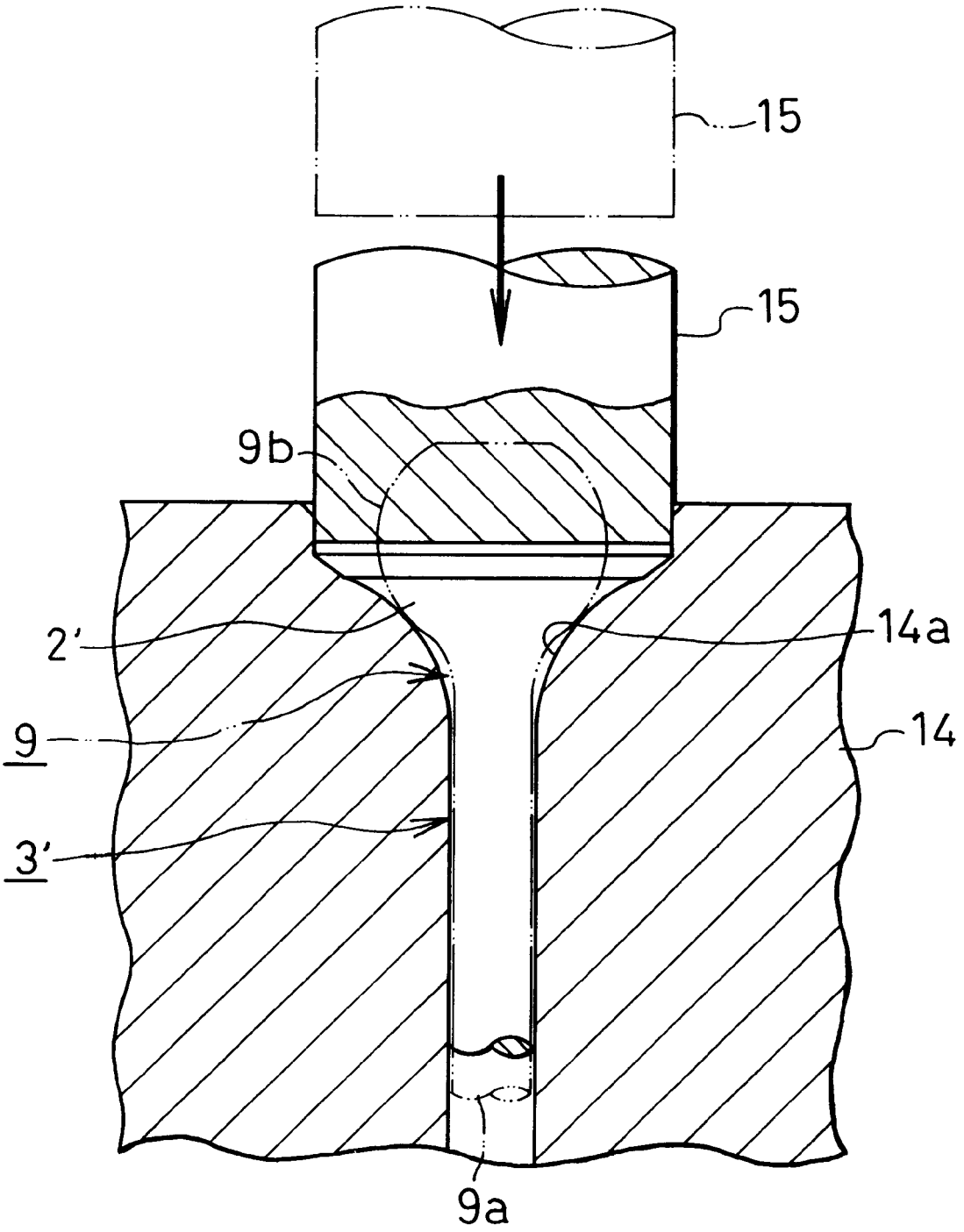
FIG. 3 is a vertical sectional front view which shows the step of forming a valve head.

The enlarged portion 9*b* is inserted into a hole 14*a* of a die 14*c* of a hot forging device in FIG. 3 before the temperature of the enlarged portion 9*a* decreases below its α transformation point. The upper part of the hole 14*a* corresponds in shape to the valve head 2 of the valve 3 to be manufactured.

Right after the valve intermediate 9 is inserted into the hole 14*a*, a punch 15 is lowered by a predetermined stroke and hot forging is applied to the enlarged portion 9*b*. Therefore, the enlarged portion 9*b* is plastically deformed to form a valve body 3' which has a valve head 2' at one end.

The valve head 2' after forming becomes an acicular α structure since the temperature of the enlarged portion 9*b* is above its β transformation point during the forming of the valve intermediate 9. The valve head 2' is rapidly cooled by the punch 15 and the die 14 during forging to make a very dense α structure.

The valve head 2' which comprises an acicular α structure has improved fatigue strength, tensile strength and creep properties at higher temperatures compared with a conventional valve to which hot forging is applied below its β transformation point.

The valve stem 9*a* which is not heated still comprises a regular α structure which is the same as the raw material to provide sufficient tensile strength which complies with strength required for the valve stem 9*a*.

Figure 4:
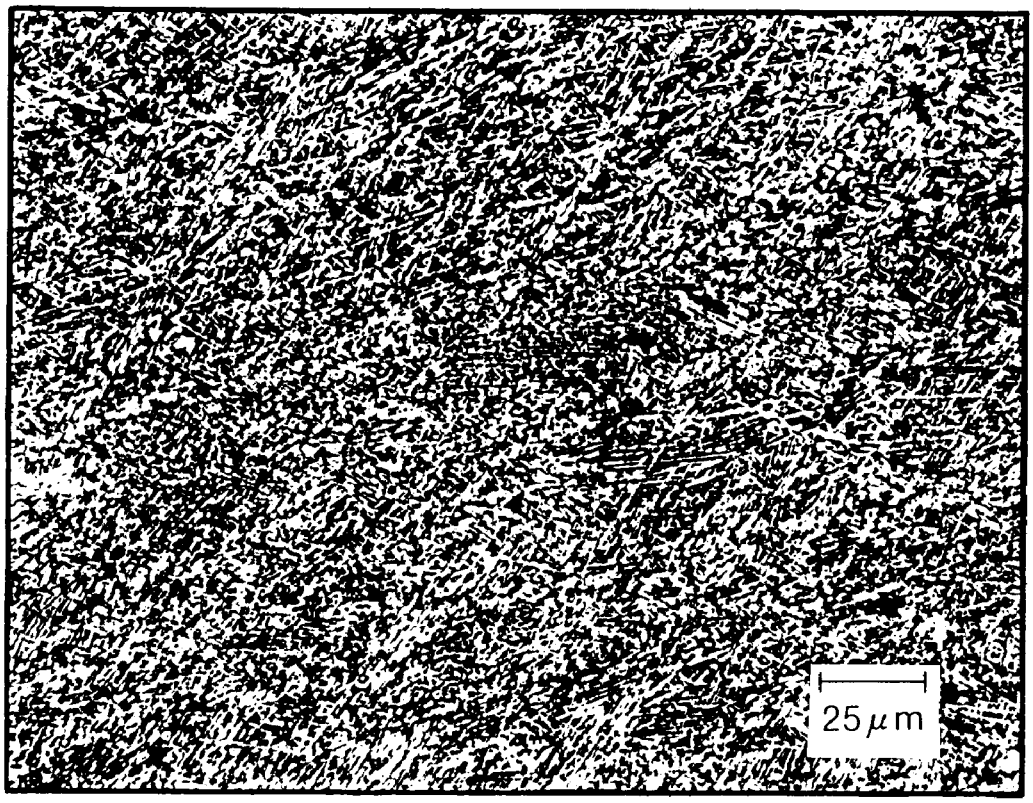
FIG. 4 is a photocopy of a micrograph of the valve head after forming.

FIG. 4 is a photocopy of a micrograph of the valve head 2' which is formed from a near α alloy such as Ti-6Al-2Sn-4Zr-2Mo, and is made of a dense acicular structure. The inventors manufactured test pieces by the same way as that of the valve head 2' from near an α alloy, Ti-6Al-2Sn-4Zr-2Mo and then measured their fatigue and tensile strengths.

Figure 5:
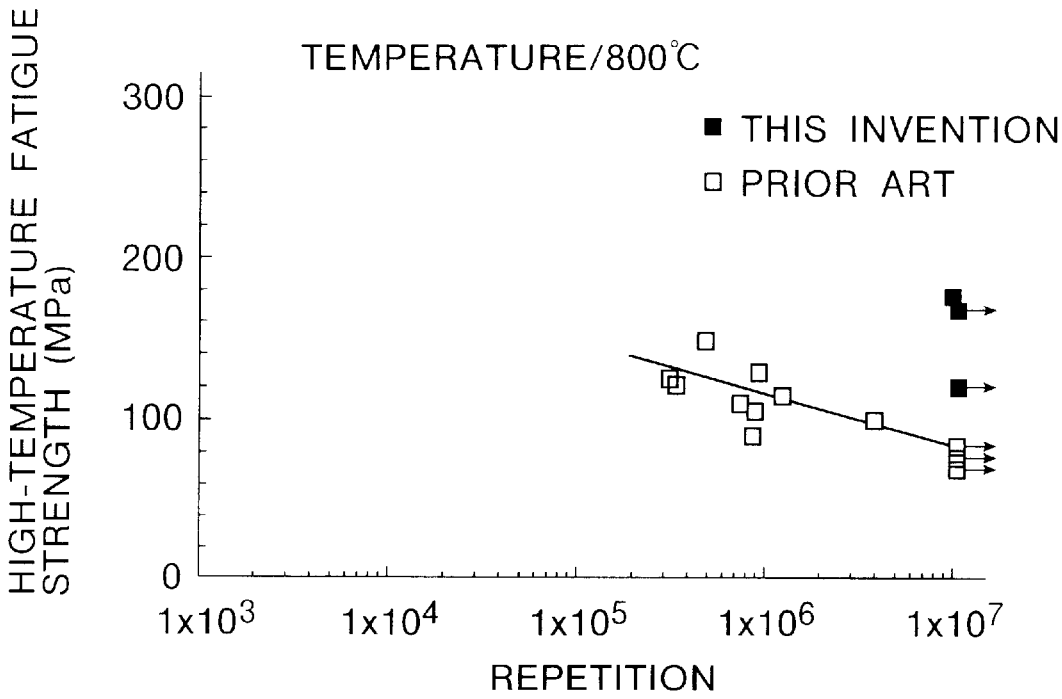
FIG. 5 is a graph which shows the results of a fatigue test.
Figure 6:
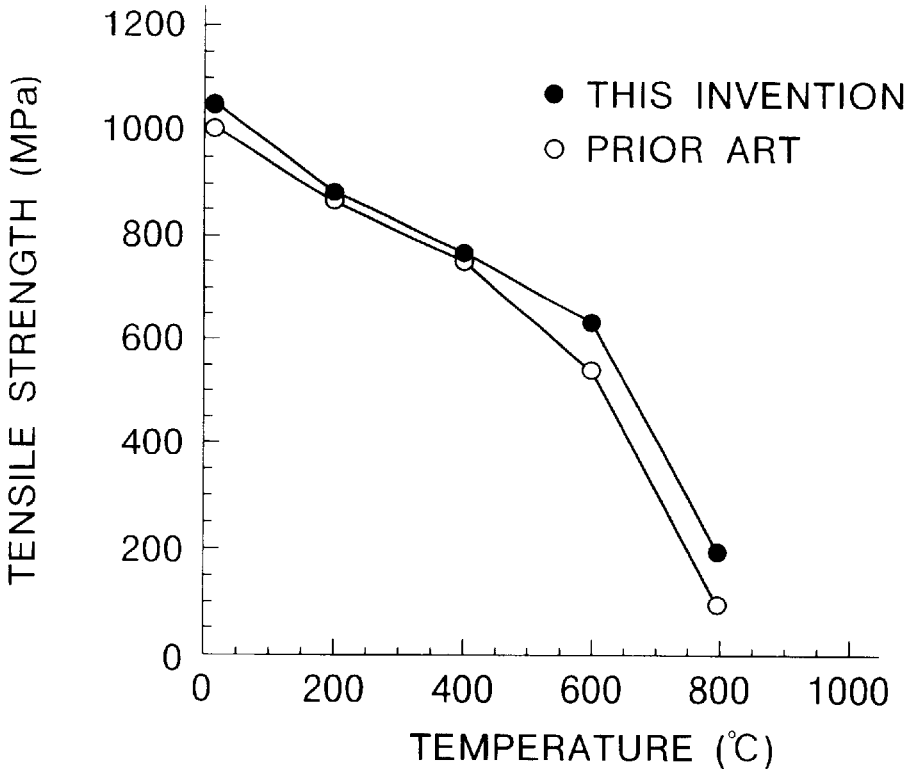
FIG. 6 is a graph which shows the results of a tensile test.

The results are shown in FIGS. 5 and 6. As shown in FIG. 5, the high-temperature fatigue strength or stress amplitude at $10^7$ times is about 190 Mpa in the present invention, while it is about 80 Mpa in the prior art which was formed at temperatures below its general β transformation point. The pieces made by the present invention have a fatigue strength which is equal to or higher than that of heat-resistant austenite steel.

Regarding tensile strength data shown in FIG. 6, the pieces made by the method of the present invention exhibit higher tensile strengths than those of the prior art over the whole temperature range. The difference becomes larger in the higher temperature range. The advantages of the acicular α structure are shown. Finish mechanical working is applied to each part of the valve body 3' in which the valve head 2' in FIG. 3 is formed. Thereafter, the above described surface treatment is applied to those valve surfaces for which wear resistance is required, thereby providing the poppet valve made of Ti alloy as shown in FIG. 1.

The foregoing relates to embodiments of the present invention. Various changes and modifications may be made by persons skilled in the art without departing from the scope of claims wherein:

What is claimed is:

1. A method of manufacturing a Ti alloy poppet valve, comprising the steps of:

heating an end of a bar material made of an (α+β) or a near α alloy which comprises a regular α structure at a temperature above its β transformation point to make an enlarged portion; and forming said enlarged portion by hot forging into a valve head having an acicular α structure.

2. A method as claimed in claim 1 wherein said step of forming said enlarged portion is immediately carried out before the temperature of the enlarged portion falls below its β transformation point.

3. A method as claimed in claim 1 wherein said step of heating the end of the bar material comprises applying an electric current to the end by electrodes of an electric forging device.

4. A method as claimed in claim 1 wherein said step of forming said enlarged portion comprises pressing the enlarged portion in a hole of a die by a punch.

5. A method as claimed in claim 1 wherein said (α+β) alloy comprises any one of Ti-6Al-4V, Ti-6Al-6V-2Sn and Ti-6Al-2Sn-4Zr-6Mo.

6. A method as claimed in claim 1 wherein said near α alloy comprises Ti-6Al-2Sn-4Zr-2Mo or Ti-8Al-1Mo-1V.

7. A method as claimed in claim 5 wherein the β transformation point is 995° C.

8. A method as claimed in claim 6 wherein the β transformation point is 1015° C.

* * * * *